US010580232B2

(12) United States Patent
Jiang et al.

(10) Patent No.: US 10,580,232 B2
(45) Date of Patent: Mar. 3, 2020

(54) APPARATUS AND METHOD THAT DIAGNOSE VEHICLE HEALTH CONDITION

(71) Applicant: GM GLOBAL TECHNOLOGY OPERATIONS LLC, Detroit, MI (US)

(72) Inventors: Shengbing Jiang, Rochester Hills, MI (US); Mutasim Salman, Rochester Hills, MI (US); Xinyu Du, Oakland Township, MI (US); Kevin A. Cansiani, Detroit, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/055,290

(22) Filed: Aug. 6, 2018

(65) Prior Publication Data

US 2020/0043258 A1 Feb. 6, 2020

(51) Int. Cl.
*G07C 5/08* (2006.01)

(52) U.S. Cl.
CPC ..... *G07C 5/0808* (2013.01); *G07C 5/085* (2013.01); *G07C 5/0825* (2013.01)

(58) Field of Classification Search
CPC ..... G07C 5/0808; G07C 5/085; G07C 5/0825
See application file for complete search history.

(56) References Cited

U.S. PATENT DOCUMENTS

| | | | | |
|---|---|---|---|---|
| 10,360,737 | B2 * | 7/2019 | Sheldon | G05B 23/02 |
| 2006/0020379 | A1 * | 1/2006 | Salman | B60T 8/885 701/30.2 |
| 2010/0268423 | A1 * | 10/2010 | Breed | B60N 2/002 701/45 |
| 2018/0047224 | A1 * | 2/2018 | Clark, IV | G07C 5/008 |
| 2018/0257683 | A1 * | 9/2018 | Govindappa | B61L 15/0081 |
| 2019/0066397 | A1 * | 2/2019 | Du | G07C 5/00 |

* cited by examiner

*Primary Examiner* — Frederick M Brushaber

(57) ABSTRACT

An apparatus and method that detect a condition of a vehicle component are provided. The method includes diagnosing vehicle health of a vehicle by analyzing one or more from among vehicle performance, vehicle energy usage, and vehicle vibration and acoustics, performing fault isolation on the vehicle to detect a health condition of a vehicle component corresponding to the isolated fault if the vehicle health below a predetermined threshold, monitoring the vehicle component corresponding to the isolated fault and estimating a remaining useful life of the vehicle component corresponding to the isolated fault, and performing one or more from among continuously monitoring, scheduling maintenance, providing a warning, and performing fault mitigation based on the estimated remaining useful life of the vehicle component corresponding to the isolated fault.

18 Claims, 9 Drawing Sheets

APPARATUS AND METHOD THAT DIAGNOSE VEHICLE HEALTH CONDITION

INTRODUCTION

Apparatuses and methods consistent with exemplary embodiments relate to diagnosing vehicle health conditions. More particularly, apparatuses and methods consistent with exemplary embodiments relate to diagnosing vehicle health conditions based on information from vehicle sensors.

SUMMARY

One or more exemplary embodiments provide a method and an apparatus that diagnose a vehicle health condition based on one or more from among vehicle performance, vehicle energy usage, and vehicle vibration and acoustics. More particularly, one or more exemplary embodiments provide a method and an apparatus that diagnose a vehicle health condition, perform fault isolation to detect a condition of a vehicle component if the vehicle health condition is below a predetermined threshold, and that perform one or more from among continuously monitoring, scheduling maintenance, providing a warning, and performing fault mitigation based on the estimated remaining useful life of the vehicle component corresponding to the isolated fault.

According to an aspect of an exemplary embodiment, a method that detects a condition of a vehicle component is provided. The method includes diagnosing vehicle health of a vehicle by analyzing one or more from among vehicle performance, vehicle energy usage, and vehicle vibration and acoustics, performing fault isolation on the vehicle to detect a health condition of a vehicle component corresponding to the isolated fault if the vehicle health below a predetermined threshold, monitoring the vehicle component corresponding to the isolated fault and estimating a remaining useful life of the vehicle component corresponding to the isolated fault; and performing one or more from among continuously monitoring, scheduling maintenance, providing a warning, and performing fault mitigation based on the estimated remaining useful life of the vehicle component corresponding to the isolated fault.

The diagnosing vehicle health of the vehicle by analyzing performance may include estimating a steering wheel angle based on motor position angle, determining a difference between the estimated steering wheel angle and an actual steering wheel angle, adjusting the vehicle health if the difference between the estimated steering wheel angle and the actual steering wheel angle is greater than a first predetermined threshold.

The diagnosing vehicle health of a vehicle by analyzing performance may include determining whether to perform vehicle motion estimation based on preset condition corresponding to measured values of steering angle, yaw rate, lateral acceleration, vehicle longitudinal speed, estimating motion values of the vehicle by estimating lateral acceleration, yaw rate, roll rate if preset condition is enabled, measuring an actual motion of the vehicle using one or more vehicle motion sensors, determining a difference between the estimated motion of the vehicle and the actual motion of the vehicle, adjusting the vehicle health if the determined difference between estimated motion of the vehicle and actual motion of the vehicle is greater than a second predetermined threshold.

The diagnosing vehicle health of a vehicle by analyzing vehicle vibration and acoustics may include determining whether vehicle vibration acoustics measurements are enabled based on a preset condition, recording one or more from among vibration information from an accelerometer and noise information from a microphone if the preset condition is enabled, determining difference between acoustic values of the recorded and measured vibration information and noise infuse information at one or more frequency bands with calibrated acoustic values of vehicles at the one or more frequency bands, and adjusting the vehicle health if the determined difference is greater than a third predetermined threshold.

The diagnosing vehicle health of a vehicle by analyzing vehicle energy usage may include determining whether vehicle motion estimation is enabled, calculating expected output average power and output total energy based on input power and energy to the vehicle and normal energy efficiency during vehicle different operation modes of vehicle including braking, acceleration, steering and cruising, estimating average power and total energy output of the vehicle based on the estimated vehicle motion, determining difference between the calculated expected output average power and output total energy and the estimated average power and total energy, and adjusting the vehicle health if the determined difference is greater than a fourth predetermined threshold The diagnosing vehicle health of a vehicle may include vehicle performance, vehicle energy usage, and vehicle vibration and acoustics, and the performing fault isolation may include detecting patterns in values associated with vehicle performance, vehicle energy usage, and vehicle vibration and acoustics, comparing the detected pattern to a table including component faults and a corresponding pattern of values associated with vehicle performance, vehicle energy usage, and vehicle vibration and acoustics, and determining the isolated fault and corresponding component based on the comparing.

The estimating the remaining useful life of the vehicle component corresponding to the isolated fault may include monitoring the component corresponding to the isolated fault for degradation, and estimating the remaining useful life of the component corresponding to the isolated fault based on the degradation.

The performing one or more from among continuously monitoring, scheduling maintenance, providing a warning, and performing fault mitigation may be performed based on the estimated remaining useful life.

The values associated with vehicle performance may include steering wheel angle, changing rate of steering wheel angle, yaw rate, lateral acceleration vehicle longitudinal speed, and roll rate, the values associated with vehicle energy usage may include average energy and average power output by a component, and the values associated with vehicle vibration and acoustics may include vehicle vibration energy and vehicle noise energy.

According to an aspect of an exemplary embodiment, an apparatus that detects a condition of a vehicle component is provided. The apparatus includes at least one memory comprising computer executable instructions and at least one processor configured to read and execute the computer executable instructions. The computer executable instructions cause the at least one processor to: diagnose vehicle health of a vehicle by analyzing one or more from among vehicle performance, vehicle energy usage, and vehicle vibration and acoustics, perform fault isolation on the vehicle to detect a health condition of a vehicle component corresponding to the isolated fault if the vehicle health is below a predetermined threshold, monitor the vehicle component corresponding to the isolated fault and estimating a remaining useful life of the vehicle component corresponding to the isolated fault, and perform one or more from among continuously monitoring, scheduling maintenance, providing a warning, and performing fault mitigation based on the estimated remaining useful life of the vehicle component corresponding to the isolated fault.

The computer executable instructions may cause the at least one processor to diagnose vehicle health of the vehicle by analyzing performance by estimating a steering wheel angle based on motor position angle, determining a difference between the estimated steering wheel angle and an actual steering wheel angle, adjusting the vehicle health if the difference between the estimated steering wheel angle and the actual steering wheel angle is greater than a first predetermined threshold.

The computer executable instructions may cause the at least one processor to diagnose vehicle health of a vehicle by analyzing performance by determining whether to perform vehicle motion estimation based on preset condition corresponding to measured values of steering angle, yaw rate, lateral acceleration, vehicle longitudinal speed, estimating motion values of the vehicle by estimating lateral acceleration, yaw rate, roll rate if preset condition is enabled, measuring an actual motion of the vehicle using one or more vehicle motion sensors, determining a difference between the estimated motion of the vehicle and the actual motion of the vehicle, adjusting the vehicle health if the determined difference between estimated motion of the vehicle and actual motion of the vehicle is greater than a second predetermined threshold.

The computer executable instructions may cause the at least one processor to diagnose vehicle health of a vehicle by analyzing vehicle vibration and acoustics by determining whether vehicle vibration acoustics measurements are enabled based on a preset condition, recording one or more from among vibration information from an accelerometer and noise information from a microphone if the preset condition is enabled, determining difference between acoustic values of the recorded and measured vibration information and noise infuse information at one or more frequency bands with calibrated acoustic values of vehicles at the one or more frequency bands, and adjusting the vehicle health if the determined difference is greater than a third predetermined threshold.

The computer executable instructions may cause the at least one processor to diagnose vehicle health of a vehicle by analyzing vehicle energy usage by determining whether vehicle motion estimation is enabled, calculating expected output average power and output total energy based on input power and energy to the vehicle and normal energy efficiency during vehicle different operation modes of vehicle including braking, acceleration, steering and cruising, estimating average power and total energy output of the vehicle based on the estimated vehicle motion, determining difference between the calculated expected output average power and output total energy and the estimated average power and total energy, and adjusting the vehicle health if the determined difference is greater than a fourth predetermined threshold.

The computer executable instructions may cause the at least one processor to diagnose vehicle health of the vehicle including vehicle performance, vehicle energy usage, and vehicle vibration and acoustics, and cause the at least one processor to perform fault isolation by detecting patterns in values associated with vehicle performance, vehicle energy usage, and vehicle vibration and acoustics, comparing the detected pattern to a table including component faults and a corresponding pattern of values associated with vehicle performance, vehicle energy usage, and vehicle vibration and acoustics, and determining the isolated fault and corresponding component based on the comparison of the detected pattern to the table including component faults.

The computer executable instructions may cause the at least one processor to estimate the remaining useful life of the vehicle component corresponding to the isolated fault by monitoring the component corresponding to the isolated fault for degradation, and estimating the remaining useful life of the component corresponding to the isolated fault based on the degradation.

The computer executable instructions cause the at least one processor to perform one or more from among continuously monitoring, scheduling maintenance, providing a warning, and performing fault mitigation is performed based on the estimated remaining useful life.

The values associated with vehicle performance may include steering wheel angle, changing rate of steering wheel angle, yaw rate, lateral acceleration vehicle longitudinal speed, and roll rate, the values associated with vehicle energy usage may include average energy and average power output by a component, and the values associated with vehicle vibration and acoustics may include vehicle vibration energy and vehicle noise energy.

The apparatus may also include one or more from among a speed sensor configured to provide vehicle performance, an energy meter configured to provide information on vehicle energy usage, and a microphone and an accelerometer configured to provide information on vehicle vibration and acoustics.

Other objects, advantages and novel features of the exemplary embodiments will become more apparent from the following detailed description of exemplary embodiments and the accompanying drawings.

BRIEF DESCRIPTION OF THE DRAWINGS

The disclosed examples will hereinafter be described in conjunction with the following drawing figures, wherein like numerals denote like elements, and wherein.

DETAILED DESCRIPTION

Figure 1:
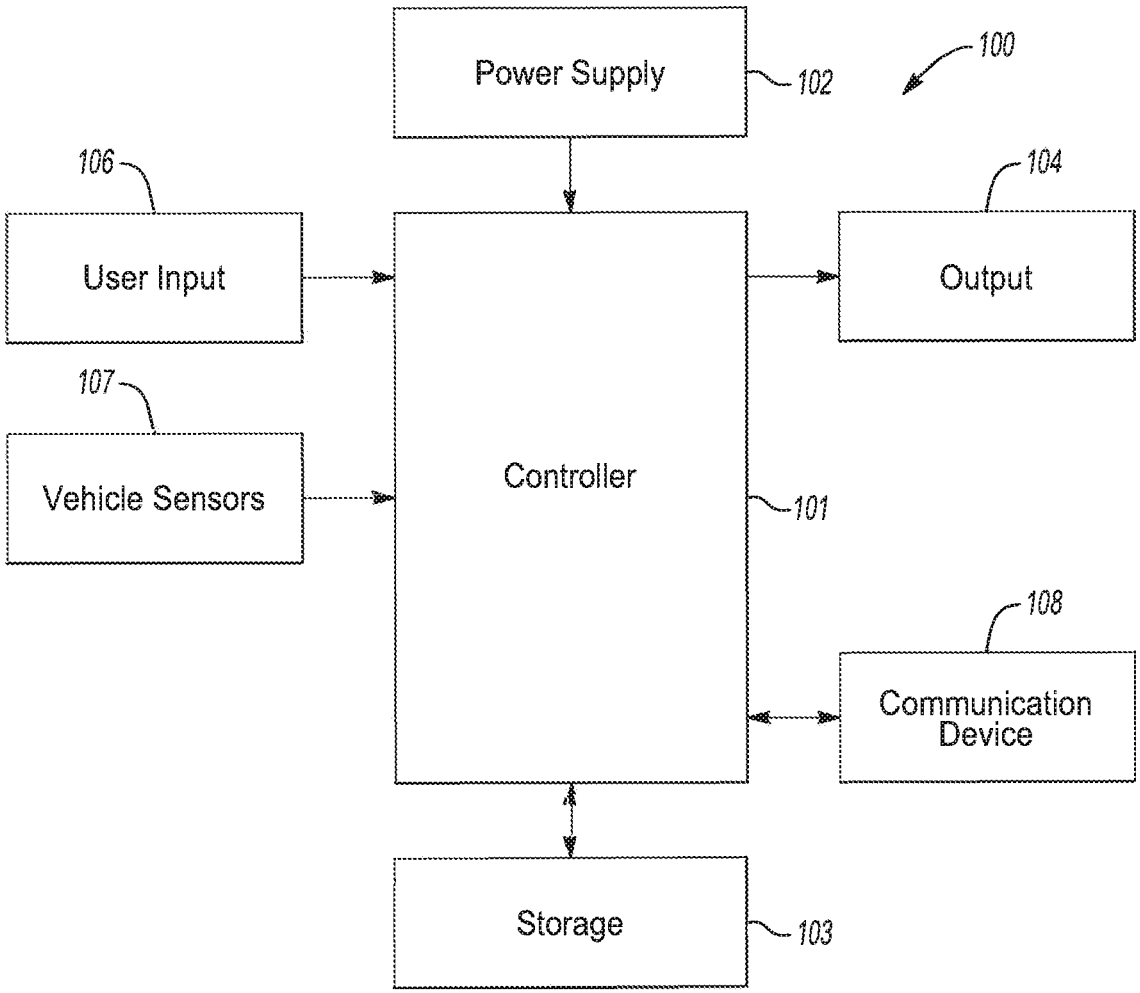
FIG. 1 shows a block diagram of an apparatus that detects a condition of a vehicle component according to an exemplary embodiment.

An apparatus and method that detect a condition of a vehicle component will now be described in detail with reference to FIGS. 1-7 of the accompanying drawings in which like reference numerals refer to like elements throughout.

The following disclosure will enable one skilled in the art to practice the inventive concept. However, the exemplary embodiments disclosed herein are merely exemplary and do not limit the inventive concept to exemplary embodiments described herein. Moreover, descriptions of features or aspects of each exemplary embodiment should typically be considered as available for aspects of other exemplary embodiments.

It is also understood that where it is stated herein that a first element is "connected to," "attached to," "formed on," or "disposed on" a second element, the first element may be connected directly to, formed directly on or disposed directly on the second element or there may be intervening elements between the first element and the second element, unless it is stated that a first element is "directly" connected to, attached to, formed on, or disposed on the second element. In addition, if a first element is configured to "send" or "receive" information from a second element, the first element may send or receive the information directly to or from the second element, send or receive the information via a bus, send or receive the information via a network, or send or receive the information via intermediate elements, unless the first element is indicated to send or receive information "directly" to or from the second element.

Throughout the disclosure, one or more of the elements disclosed may be combined into a single device or into one or more devices. In addition, individual elements may be provided on separate devices.

As a vehicle is driven, the vehicle may exhibit various symptoms in the form of noise, underperforming components, inefficient energy usage, and/or other issues relating to the operation of the vehicle. Some of these symptoms or issues, on their own, are not indicative of an imminent failure or a vehicle condition that needs immediate remedying. However, when the symptoms or issues are detected and tracked, they can provide useful information to an operator of a vehicle such as the estimated remaining useful life of a component, a condition of a component of a vehicle and a component that needs maintenance for the optimal performance of a vehicle.

FIG. 1 shows a block diagram of an apparatus that detects a condition of a vehicle component 100 according to an exemplary embodiment. As shown in FIG. 1, the apparatus that detects a condition of a vehicle component 100, according to an exemplary embodiment, includes a controller 101, a power supply 102, a storage 103, an output 104, a user input 106, a vehicle sensor 107, and a communication device 108. However, the apparatus that detects a condition of a vehicle component 100 is not limited to the aforementioned configuration and may be configured to include additional elements and/or omit one or more of the aforementioned elements. The apparatus that detects a condition of a vehicle component 100 may be implemented as part of a vehicle, as a standalone component, as a hybrid between an on vehicle and off vehicle device, or in another computing device.

The controller 101 controls the overall operation and function of the apparatus that detects a condition of a vehicle component 100. The controller 101 may control one or more of a storage 103, an output 104, a user input 106, a vehicle sensor 107, and a communication device 108 of the apparatus that detects a condition of a vehicle component 100. The controller 101 may include one or more from among a processor, a microprocessor, a central processing unit (CPU), a graphics processor, Application Specific Integrated Circuits (ASICs), Field-Programmable Gate Arrays (FPGAs), state machines, circuitry, and a combination of hardware, software and firmware components.

The controller 101 is configured to send and/or receive information from one or more of the storage 103, the output 104, the user input 106, the vehicle sensor 107, and the communication device 108 of the apparatus that detects a condition of a vehicle component 100. The information may be sent and received via a bus or network, or may be directly read or written to/from one or more of the storage 103, the output 104, the user input 106, the vehicle sensor 107, and the communication device 108 of the apparatus that detects a condition of a vehicle component 100. Examples of suitable network connections include a controller area network (CAN), a media oriented system transfer (MOST), a local interconnection network (LIN), a local area network (LAN), wireless networks such as Bluetooth and 802.11, and other appropriate connections such as Ethernet.

The power supply 102 provides power to one or more of the controller 101, the storage 103, the output 104, the user input 106, the vehicle sensor 107, and the communication device 108, of the apparatus that detects a condition of a vehicle component 100. The power supply 102 may include one or more from among a battery, a power outlet, a capacitor, a solar energy cell, a generator, a wind energy device, an alternator, etc.

The storage 103 is configured for storing information and retrieving information used by the apparatus that detects a condition of a vehicle component 100. The storage 103 may be controlled by the controller 101 to store and retrieve information received from the vehicle sensor 107 and the communication device 108. The storage 103 may also include the computer instructions configured to be executed by a processor to perform the functions of the apparatus that detects a condition of a vehicle component 100.

The information stored by the storage 103 may include information on one or more from among one or more from among vehicle performance, vehicle energy usage, and vehicle vibration and acoustics, vehicle health, estimated remaining useful life, and an isolated fault of a vehicle component. The information on vehicle performance may include estimated vehicle motion, speed, acceleration, direction, and actual vehicle motion, speed, acceleration, direction etc. The information on vehicle vibration and acoustics may include one or more from among vibration information and noise information. The noise information may include the amplitude of the frequency response at certain frequency, the energy over the certain frequency band, or the energy over certain time period. The information on vehicle energy usage may include one or more from among average power usage and total energy input.

The storage 103 may include one or more from among floppy diskettes, optical disks, CD-ROMs (Compact Disc-Read Only Memories), magneto-optical disks, ROMs (Read Only Memories), RAMs (Random Access Memories), EPROMs (Erasable Programmable Read Only Memories), EEPROMs (Electrically Erasable Programmable Read Only Memories), magnetic or optical cards, flash memory, cache memory, and other type of media/machine-readable medium suitable for storing machine-executable instructions.

The output 104 outputs information in one or more forms including: visual, audible and/or haptic form. The output 104 may be controlled by the controller 101 to provide outputs to the user of the apparatus that detects a condition of a vehicle component 100. The output 104 may include one or more from among a speaker, audio, a display, a centrally-located display, a head up display, a windshield display, a haptic feedback device, a vibration device, a tactile feedback device, a tap-feedback device, a holographic display, an instrument light, an indicator light, etc.

The output 104 may output notification including one or more from among an audible notification, a light notification, and a display notification. The notification may include information on one or more from among continuously monitoring a condition of a vehicle component, scheduling maintenance for a vehicle, providing a warning about health of a vehicle or vehicle component, and performing fault mitigation to address a condition of a vehicle component.

The user input 106 is configured to provide information and commands to the apparatus that detects a condition of a vehicle component 100. The user input 106 may be used to provide user inputs, etc., to the controller 101. The user input 106 may include one or more from among a touchscreen, a keyboard, a soft keypad, a button, a motion detector, a voice input detector, a microphone, a camera, a trackpad, a mouse, a touchpad, etc. The user input 106 may be configured to receive a user input to acknowledge or dismiss the notification output by the output 104. The user input 106 may also be configured to receive a user input to activate or deactivate the apparatus that detects a condition of a vehicle component 100. For example, the setting to turn the system on or off may be selected by an operator via user input 106.

The vehicle sensor 107 may include one or more from among a plurality of sensors configured to measure or detect information on one or more from among a vehicle component, vehicle performance, vehicle energy usage, and vehicle vibration and acoustics. Examples of sensors may include a transducer, a wheel speed tachometer, an inertial measurement unit (IMU) such as an accelerometer, a gyroscope, a magnetometer, electronic power steering (EPS) motor current sensors, a power meter, a voltmeter, a current sensor, etc.

For example, vibration information or other information could be detected from the accelerometer outputs, such as longitudinal acceleration, lateral acceleration, vertical acceleration, or inertial measurement unit (IMU) outputs such as yaw rate, pitch rate, roll rate. Other examples of information sources include vehicle motion signals such as wheel speed, vehicle speed (driven or nondriven), and subsystem signals such as brake system master cylinder pressure, steering wheel angle, steering motor torque, brake torque, axle torque, etc. The noise information may be measured from one or more microphones.

The communication device 108 may be used by apparatus that detects a condition of a vehicle component 100 to communicate with several types of external apparatuses according to various communication methods. The communication device 108 may be used to send/receive information on or more from among vehicle performance, vehicle energy usage, and vehicle vibration and acoustics, vehicle health, estimated remaining useful life, and an isolated fault of a vehicle component.

The communication device 108 may include various communication modules such as one or more from among a telematics unit, a broadcast receiving module, a near field communication (NFC) module, a GPS receiver, a wired communication module, or a wireless communication module. The broadcast receiving module may include a terrestrial broadcast receiving module including an antenna to receive a terrestrial broadcast signal, a demodulator, and an equalizer, etc. The NFC module is a module that communicates with an external apparatus located at a nearby distance according to an NFC method. The GPS receiver is a module that receives a GPS signal from a GPS satellite and detects a current location. The wired communication module may be a module that receives information over a wired network such as a local area network, a controller area network (CAN), or an external network. The wireless communication module is a module that is connected to an external network by using a wireless communication protocol such as IEEE 802.11 protocols, WiMAX, Wi-Fi or IEEE communication protocol and communicates with the external network. The wireless communication module may further include a mobile communication module that accesses a mobile communication network and performs communication according to various mobile communication standards such as $3^{rd}$ generation (3G), $3^{rd}$ generation partnership project (3GPP), long-term evolution (LTE), Bluetooth, EVDO, CDMA, GPRS, EDGE or ZigBee.

According to an exemplary embodiment, the controller 101 of the apparatus that that detects a condition of a vehicle component 100 may be configured to diagnose vehicle health of a vehicle by analyzing one or more from among vehicle performance, vehicle energy usage, and vehicle vibration and acoustics, perform fault isolation on the vehicle to detect a health condition of a vehicle component corresponding to the isolated fault if the vehicle health is below a predetermined threshold, monitor the vehicle component corresponding to the isolated fault and estimate a remaining useful life of the vehicle component corresponding to the isolated fault, and perform one or more from among continuously monitoring, scheduling maintenance, providing a warning, and performing fault mitigation based on the estimated remaining useful life of the vehicle component corresponding to the isolated fault.

The controller 101 of the apparatus that that detects a condition of a vehicle component 100 may be configured to diagnose vehicle health of the vehicle by analyzing performance by estimating a steering wheel angle based on motor position angle, determining a difference between the estimated steering wheel angle and an actual steering wheel angle, adjusting the vehicle health if the difference between the estimated steering wheel angle and the actual steering wheel angle is greater than a first predetermined threshold.

The controller 101 of the apparatus that that detects a condition of a vehicle component 100 may be configured to diagnose vehicle health of the vehicle including vehicle performance, vehicle energy usage, and vehicle vibration and acoustics, and to perform fault isolation by detecting patterns in values associated with vehicle performance, vehicle energy usage, and vehicle vibration and acoustics, comparing the detected pattern to a table including component faults and a corresponding pattern of value associated with vehicle performance, vehicle energy usage, and vehicle vibration and acoustics, and determining the isolated fault and corresponding component based on the comparison of the detected pattern to the table including component faults.

The controller 101 of the apparatus that that detects a condition of a vehicle component 100 may be configured to estimate the remaining useful life of the vehicle component corresponding to the isolated fault by monitoring the component corresponding to the isolated fault for degradation, and estimating the remaining useful life of the component corresponding to the isolated fault based on the degradation.

The controller 101 of the apparatus that that detects a condition of a vehicle component 100 may be configured to perform one or more from among continuously monitoring, scheduling maintenance, providing a warning, and performing fault mitigation is performed based on the estimated remaining useful life.

Figure 2:
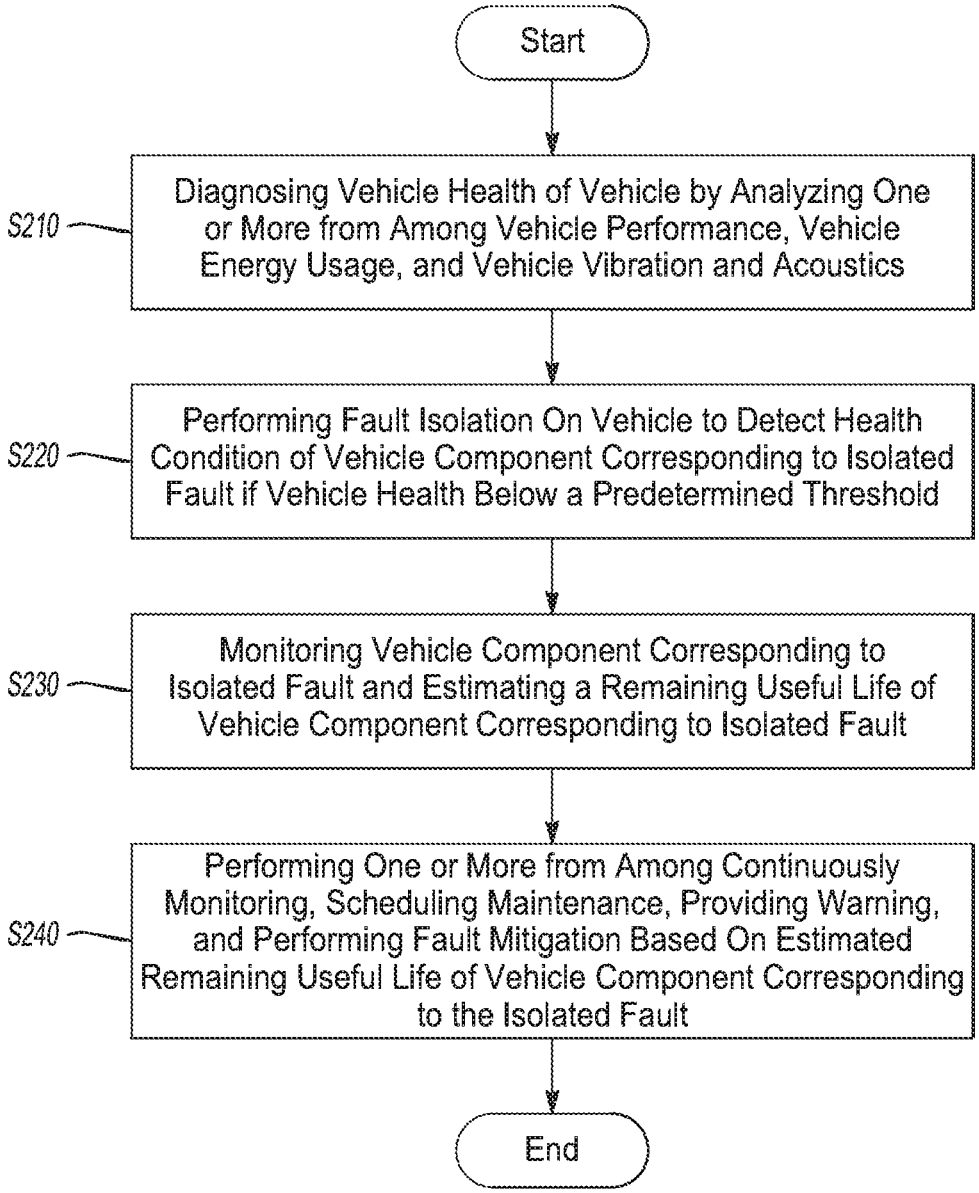
FIG. 2 shows a flowchart for a method of detecting a condition of a vehicle component according to an exemplary embodiment.

FIG. 2 shows a flowchart for a method of detecting a condition of a vehicle component according to an exemplary embodiment. The method of FIG. 2 may be performed by the apparatus detects a condition of a vehicle component 100 or may be encoded into a computer readable medium as instructions that are executable by a computer to perform the method.

Referring to FIG. 2, the diagnosing of vehicle health of a vehicle is performed by analyzing one or more from among vehicle performance, vehicle energy usage, and vehicle vibration and acoustics in operation S210. Fault isolation on the vehicle to detect a health condition of a vehicle component corresponding to the isolated fault is performed in operation S220 if the vehicle health determined in operation S210 is below a predetermined threshold. Then, in operation S230, the vehicle component corresponding to the isolated fault is monitored and the estimated remaining useful life of the vehicle component corresponding to the isolated fault is determined. In operation S240, one or more from among continuously monitoring, scheduling maintenance, providing a warning, and performing fault mitigation based on the estimated remaining useful life of the vehicle component corresponding to the isolated fault is performed.

Figure 3A:
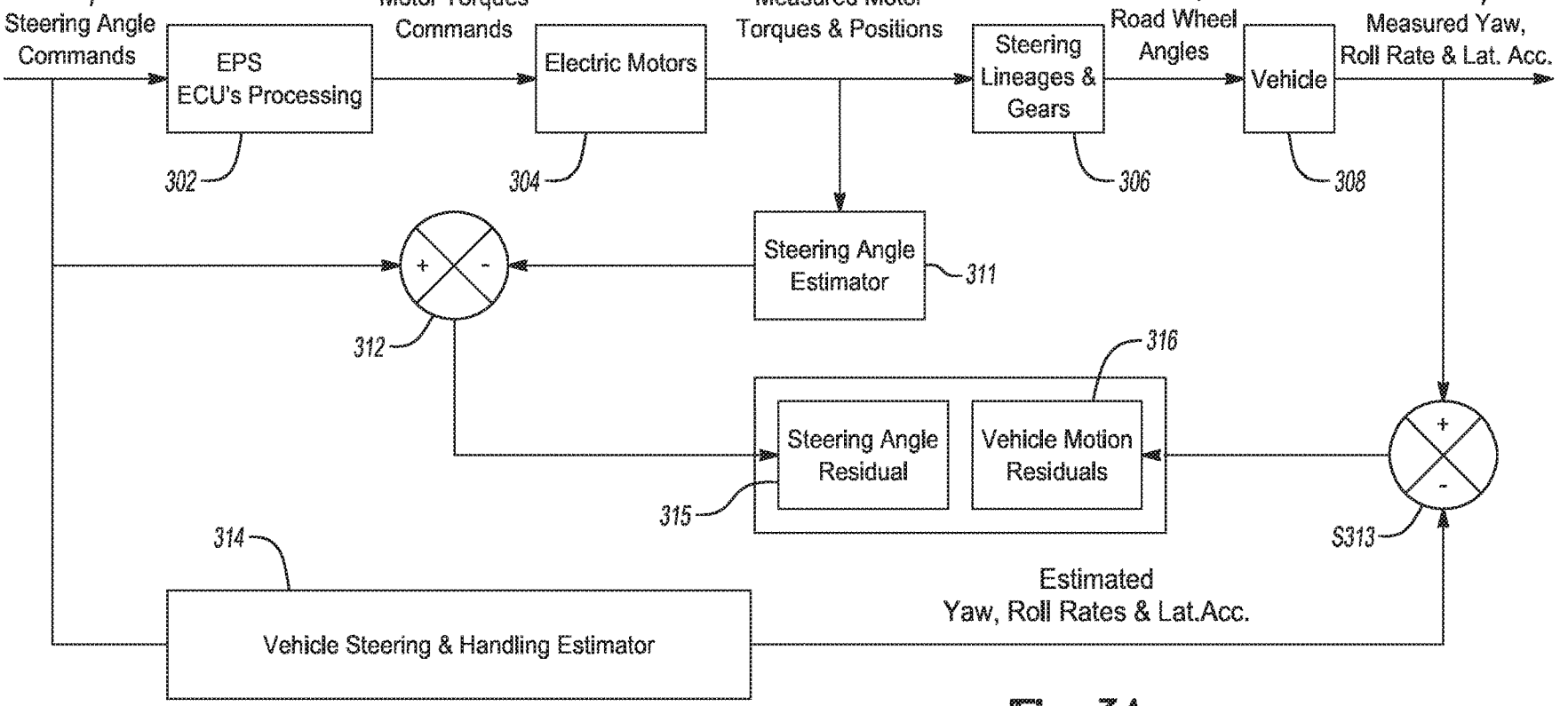
FIG. 3A shows a flow diagram of diagnosing vehicle health by analyzing performance according to an aspect of an exemplary embodiment.

FIG. 3A shows a flow diagram of diagnosing vehicle health by analyzing vehicle performance according to an aspect of an exemplary embodiment.

Referring to FIG. 3A, steering angle commands are input, in operation S301, to the electronic power steering 302 and the vehicle steering and handling estimator 314. The electronic power steering 302 processes the steering angle commands and outputs motor torque commands in operation S303. Electric motors 304 perform an operation based on the motor torque commands and the measured motor torques and positions are output to steering lineages and gears 306 and a steering angle estimator 311 in operation S305. The steering lineages and gears 306 control the road wheel angles in operation S307, which moves the vehicle 308. From the motion of the vehicle 308, yaw, roll rate and lateral acceleration are measured by sensors in operation S309.

The steering angle estimator 311 compares the estimated steering angle and the input steering angle commands in operation S312 and outputs and stores a difference value or residual value 315. The vehicle steering and handling estimator 314 estimates yaw, roll rates and lateral acceleration based on the input steering angle command. The measured yaw, roll rate and lateral acceleration are compared to estimated yaw, roll rates and lateral acceleration in operation S313. The vehicle motion residuals 316 or the difference between measured yaw, roll rate and lateral acceleration and the estimated yaw, roll rates and lateral acceleration are determined based on the comparison and stored.

Figure 3B:
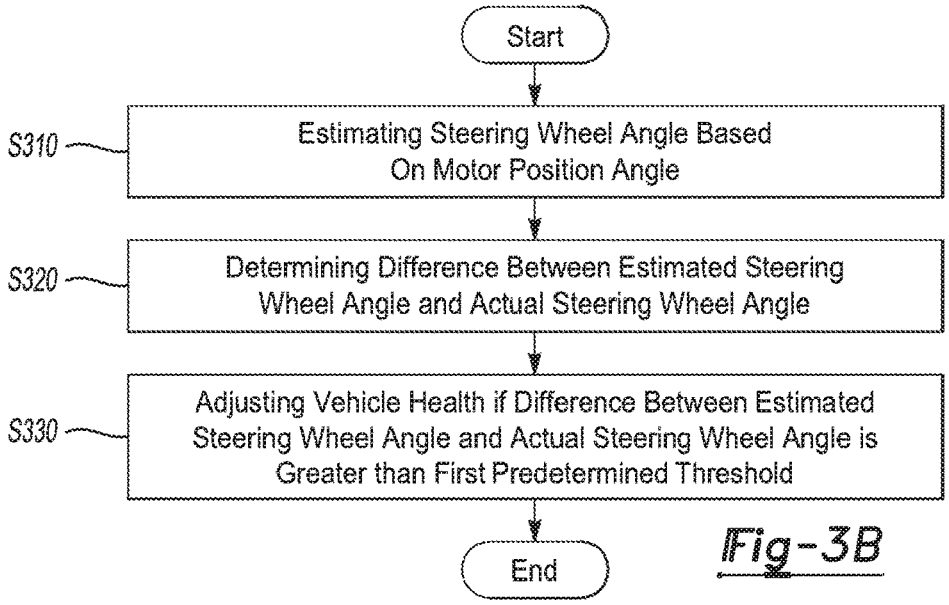
FIGS. 3B and 3C show flowcharts for a method of diagnosing vehicle health by analyzing performance according to several aspects of an exemplary embodiment.
Figure 3C:
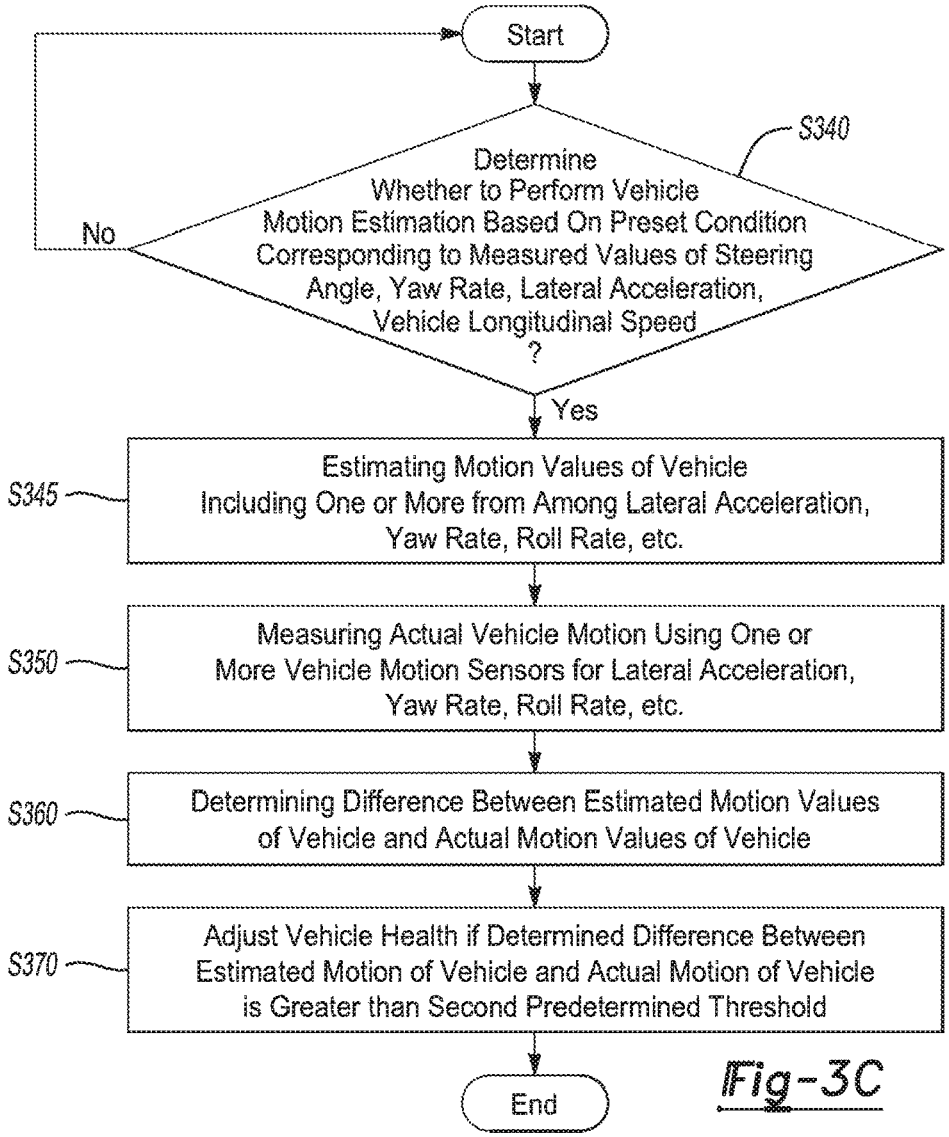

FIGS. 3B and 3C shows flowcharts for a method of diagnosing vehicle health by analyzing performance according to several aspects of an exemplary embodiment. The methods of FIGS. 3A and 3B may be performed by the apparatus detects a condition of a vehicle component 100 or may be encoded into a computer readable medium as instructions that are executable by a computer to perform the method.

Referring to FIG. 3B, a steering wheel angle is estimated based on a motor position angle in operation S310. The difference between the estimated steering wheel angle and the actual steering wheel angle is determined in operation S320. Next, in operation S330, vehicle health is diagnosed and a vehicle health condition is adjusted if the difference between the estimated steering wheel angle and the actual steering wheel angle is greater than first predetermined threshold.

Referring to FIG. 3C, it is determined whether to perform the vehicle motion estimation based on a preset enable condition corresponding to measured values of steering angle, yaw rate, lateral acceleration, vehicle longitudinal speed, etc. If the preset condition is enabled, estimating one or more from among lateral acceleration, yaw rate, roll rate is performed for the motion of the vehicle in operation S345. In operation S350, actual vehicle motion is measured using one or more vehicle motion sensors. The difference between the estimated motion of the vehicle and the actual motion of the vehicle is determined in operation S360. Next, in operation S360, vehicle health is diagnosed and a vehicle health condition is adjusted if the difference between the estimated motion of vehicle and actual motion of vehicle is greater than second predetermined threshold.

Figure 4A:
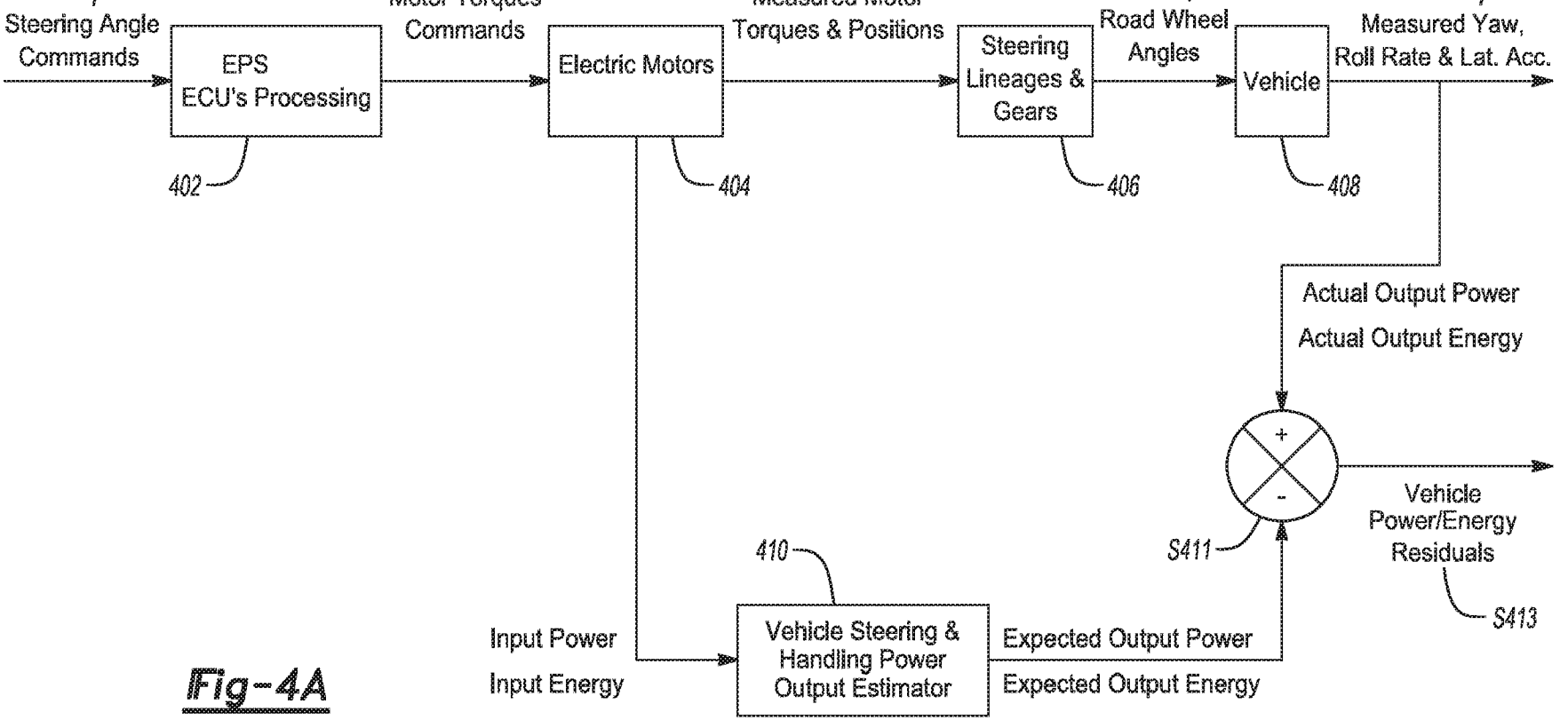
FIGS. 4A and 4B show a flow diagram and a flowchart for diagnosing vehicle health by analyzing vehicle energy usage according to an aspect of an exemplary embodiment.
Figure 4B:
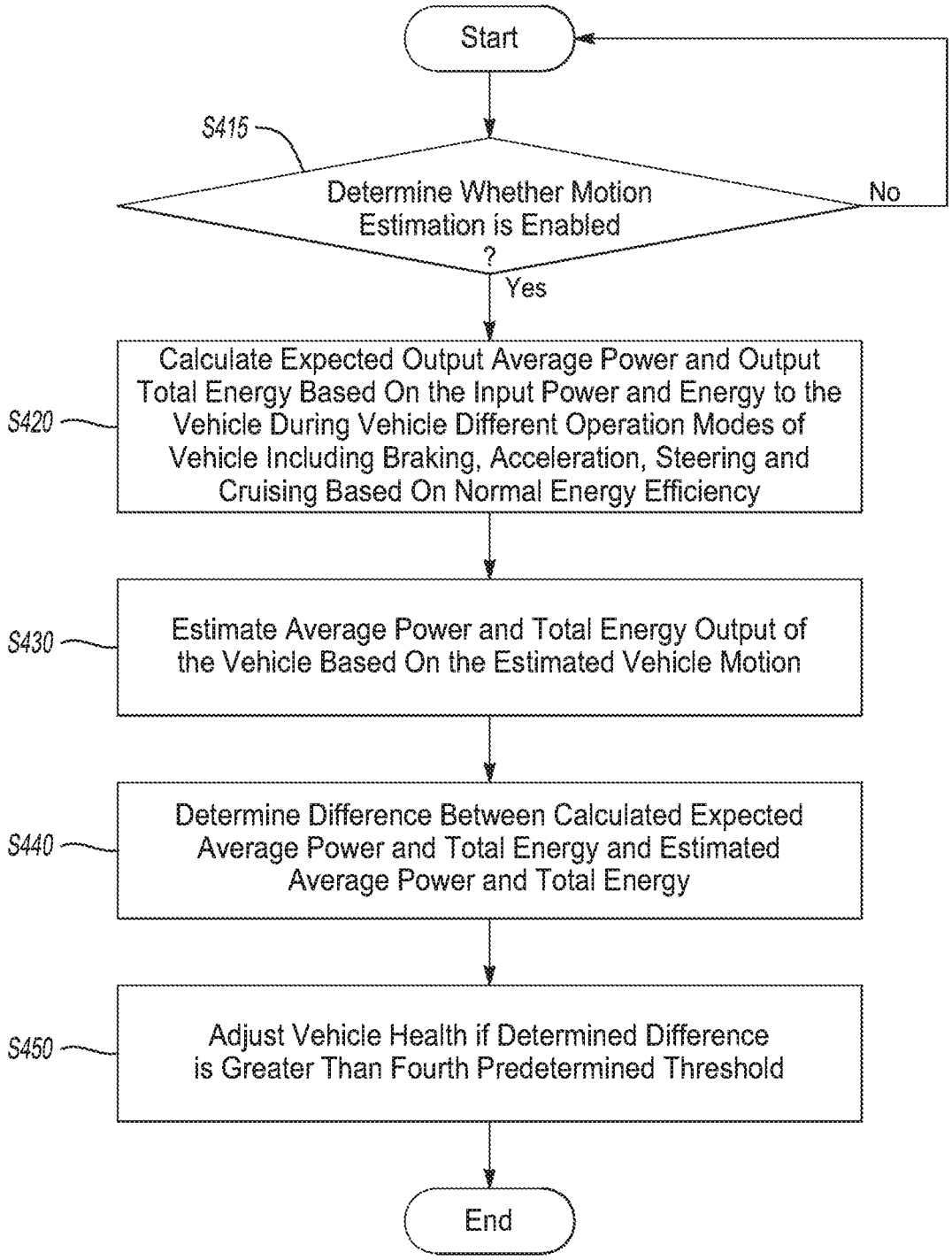

FIGS. 4A and 4B show a flow diagram and a flowchart for diagnosing vehicle health by analyzing vehicle energy usage according to an aspect of an exemplary embodiment. In a vehicle system, there is energy conversion from one type of energy to another as well as conservation of energy. There is input energy, lost or dissipated energy (e.g. electrical losses, mechanical losses, friction, thermal losses, etc.) and output energy. In a healthy vehicle, the distribution of energy and the amount of energy loss is within an expected range. If there is any increase in the amount of energy loss (e.g., more friction in the system, increase in electrical resistance, etc.), then the dissipative energy will increase causing a reduction in the resulting output energy for the same input energy.

In one example related to a vehicle braking and acceleration system where electric motors are used. The input power to the system is voltage (v) multiplied by current (i). The total energy used as input from time t1 to time t2 is $$\int_{t1}^{t2} v * i\,dt.$$

This energy will be used to reduce (increase in case of vehicle acceleration) the kinetic energy of the vehicle from vehicle speed V(t1) to vehicle speed V(t2). The change in the output energy will be $$\frac{1}{2}mV^2(t1) - \frac{1}{2}mV^2(t2),$$

where m is vehicle mass. The average efficiency of the system can be computed by the change in output energy divided the change in input energy or the average output power over the average input power. The energy losses can also be computed by finding the difference between the output and the input energy changes.

Referring to FIG. 4A, steering angle commands are input, in operation S401, to the electronic power steering 402. The electronic power steering 402 processes the steering angle commands and outputs motor torque commands in operation S403. In operation S403, motor torque commands are send to electric motors 404 and input power and input energy are sent from electric motors 404 to the vehicle steering and handling power estimator 410.

Electric motors 404 perform an operation based on the motor torque commands. The motor torques and positions are measured in operation S405 and used to move the steering lineages and gears 406. The steering lineages and gears 406 control the road wheel angle in operation S407 that moves vehicle 408. Based on the motion of the vehicle, yaw, roll rate and lateral acceleration is measured and used to determine actual output power and actual output energy in operation S409.

The vehicle steering and handling power estimator 410 determines the estimated or expected output power and estimated or expected output energy based on the input power and input energy. The expected output power and expected output energy are compared to the actual output power and actual output energy of electric motors in operation S411 and the vehicle power and energy residuals or the difference between the expected output power and output energy and the actual output power and output energy of electric motors is output and stored in operation S413.

The method of FIG. 4B may be performed by the apparatus detects a condition of a vehicle component 100 or may be encoded into a computer readable medium as instructions that are executable by a computer to perform the method. Referring to FIG. 4B, it is determined whether motion estimation is enabled in operation S415. If motion estimation is enabled, the expected output average power and output total energy are calculated based on the input power and energy to the vehicle and normal energy efficiency (e.g., energy efficiency within a preset range or predetermined range) during different operation modes of vehicle including braking, acceleration, steering and cruising in operation S420. The average power and total energy usage of the vehicle is then estimated based on the estimated vehicle motion in operation S430.

In operation S440, the difference between calculated expected average power and total energy and estimated average power and total energy is determined. Then, in operation S450, vehicle health is diagnosed and a vehicle health condition is adjusted if determined difference between calculated average power and total energy usage and estimated average power and total energy usage is greater than a fourth predetermined threshold.

Figure 5:
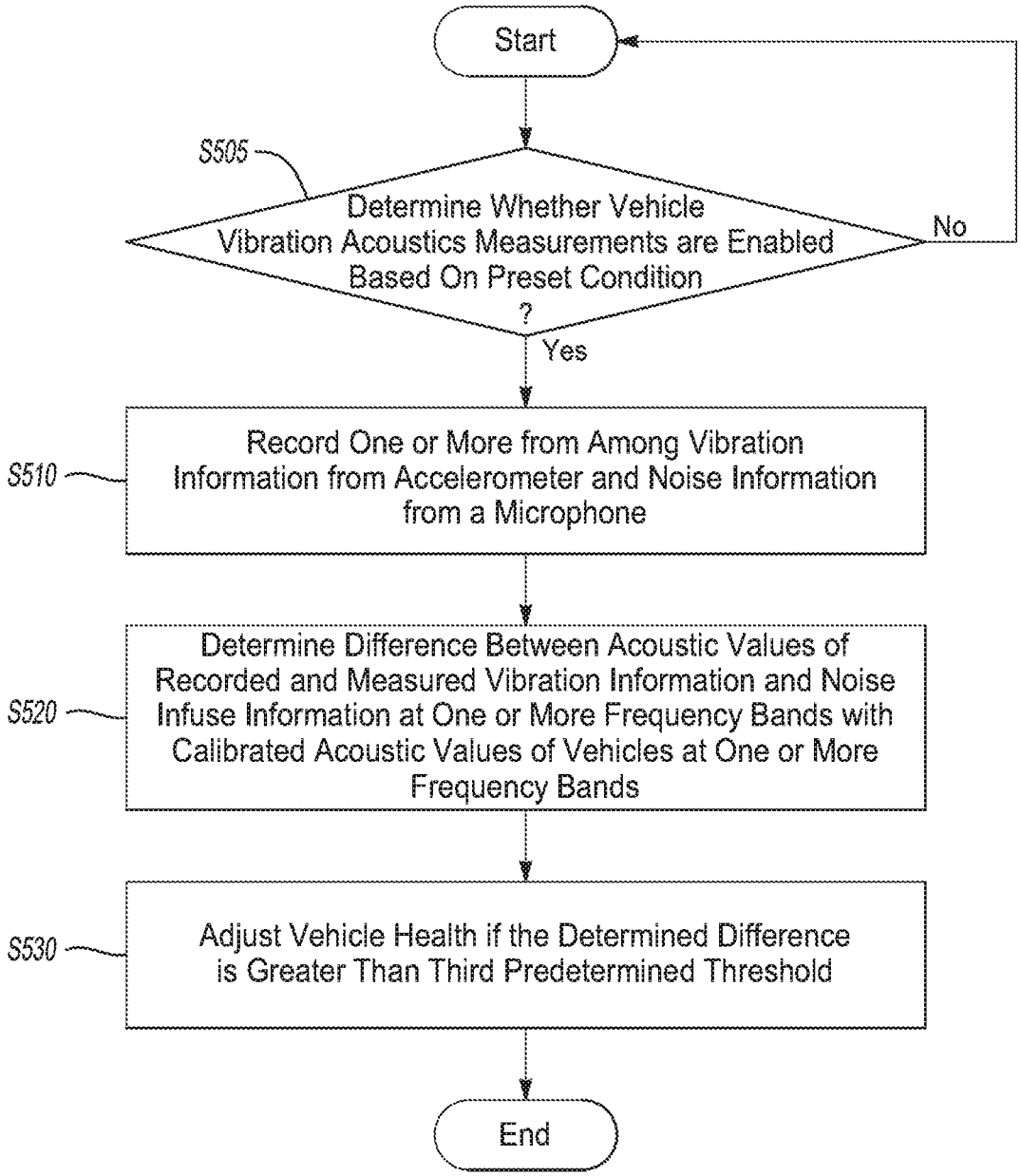
FIG. 5 shows a flowchart for diagnosing vehicle health by analyzing vehicle vibration and acoustics according to an aspect of an exemplary embodiment.

FIG. 5 shows a flowchart for diagnosing vehicle health by analyzing vehicle vibration and acoustics according to an aspect of an exemplary embodiment. The method of FIG. 5 may be performed by the apparatus detects a condition of a vehicle component 100 or may be encoded into a computer readable medium as instructions that are executable by a computer to perform the method.

Referring to FIG. 5, in operation S505, it is determined whether vehicle vibration and/or acoustics measurements are enabled based on a preset setting. If the vehicle vibration and/or acoustics measurements are enabled, one or more from among vibration information from an accelerometer and noise information from a microphone are recorded or stored. In operation S520, differences between acoustic values of recorded and measured vibration information, and between noise infuse information at one or more frequency bands with calibrated acoustic values of vehicles at one or more frequency bands, are determined. Then, in operation S530, a vehicle health condition is adjusted based on the determined difference if the determined difference is greater than third predetermined threshold.

Figure 6:
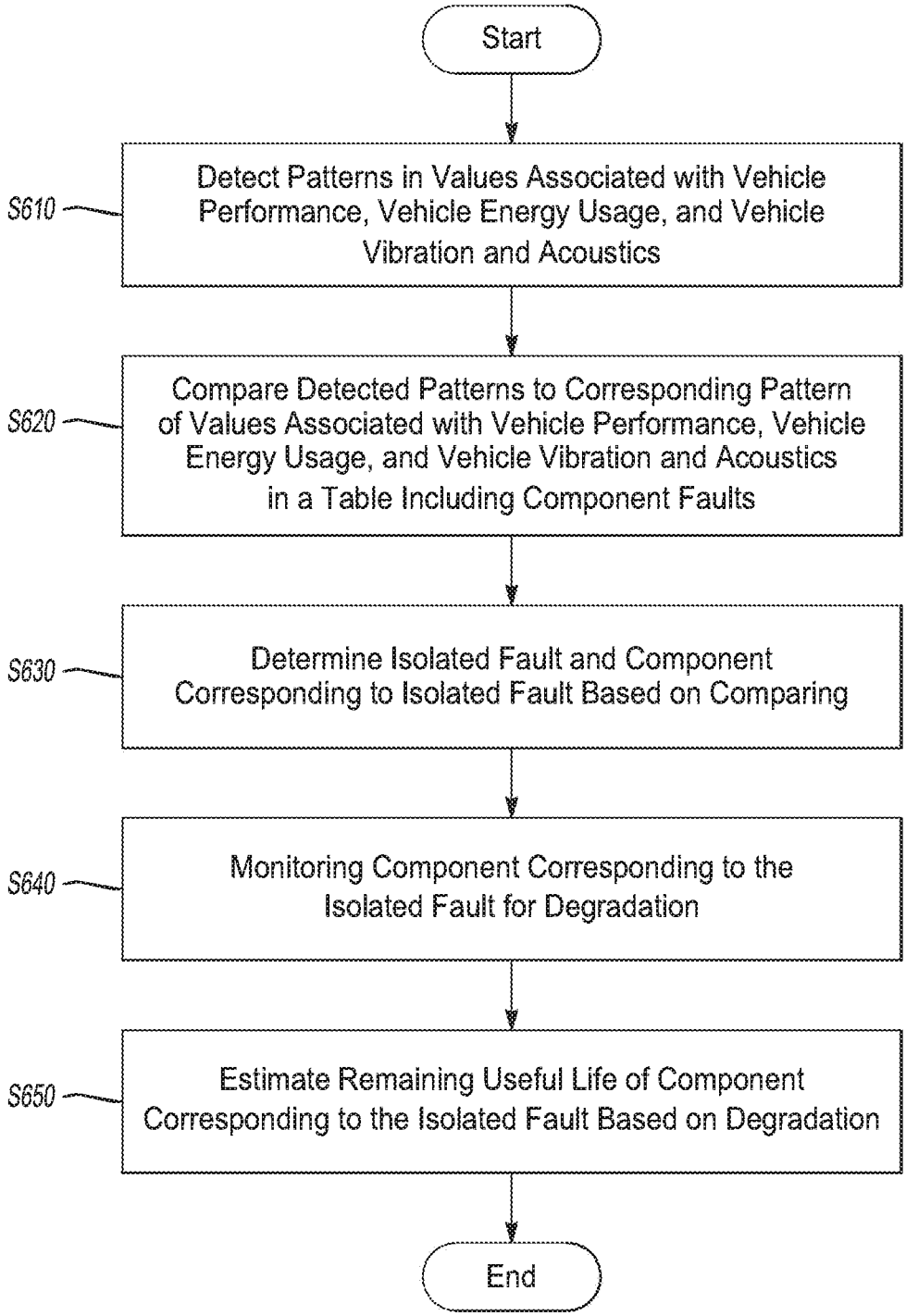
FIG. 6 shows a flowchart for performing fault isolation and estimating remaining useful life according to an aspect of an exemplary embodiment.

FIG. 6 shows a flowchart for performing fault isolation and estimating remaining useful life according to an aspect of an exemplary embodiment. The method of FIG. 6 may be performed by the apparatus detects a condition of a vehicle component 100 or may be encoded into a computer readable medium as instructions that are executable by a computer to perform the method.

Referring to FIG. 6, patterns in values associated with vehicle performance, vehicle energy usage, and vehicle vibration and acoustics detected in operation S610. The detected patterns are compared to corresponding pattern of values associated with vehicle performance, vehicle energy usage, and vehicle vibration and acoustics in a table including component faults in operation S620. The isolated fault and component corresponding to isolated fault is determined in operation S630 based on comparison in operation S620. The component corresponding to the isolated fault is monitored for degradation in operation S640. The remaining useful life of component corresponding to the isolated fault is estimated based on the degradation in operation S650.

Figure 7:
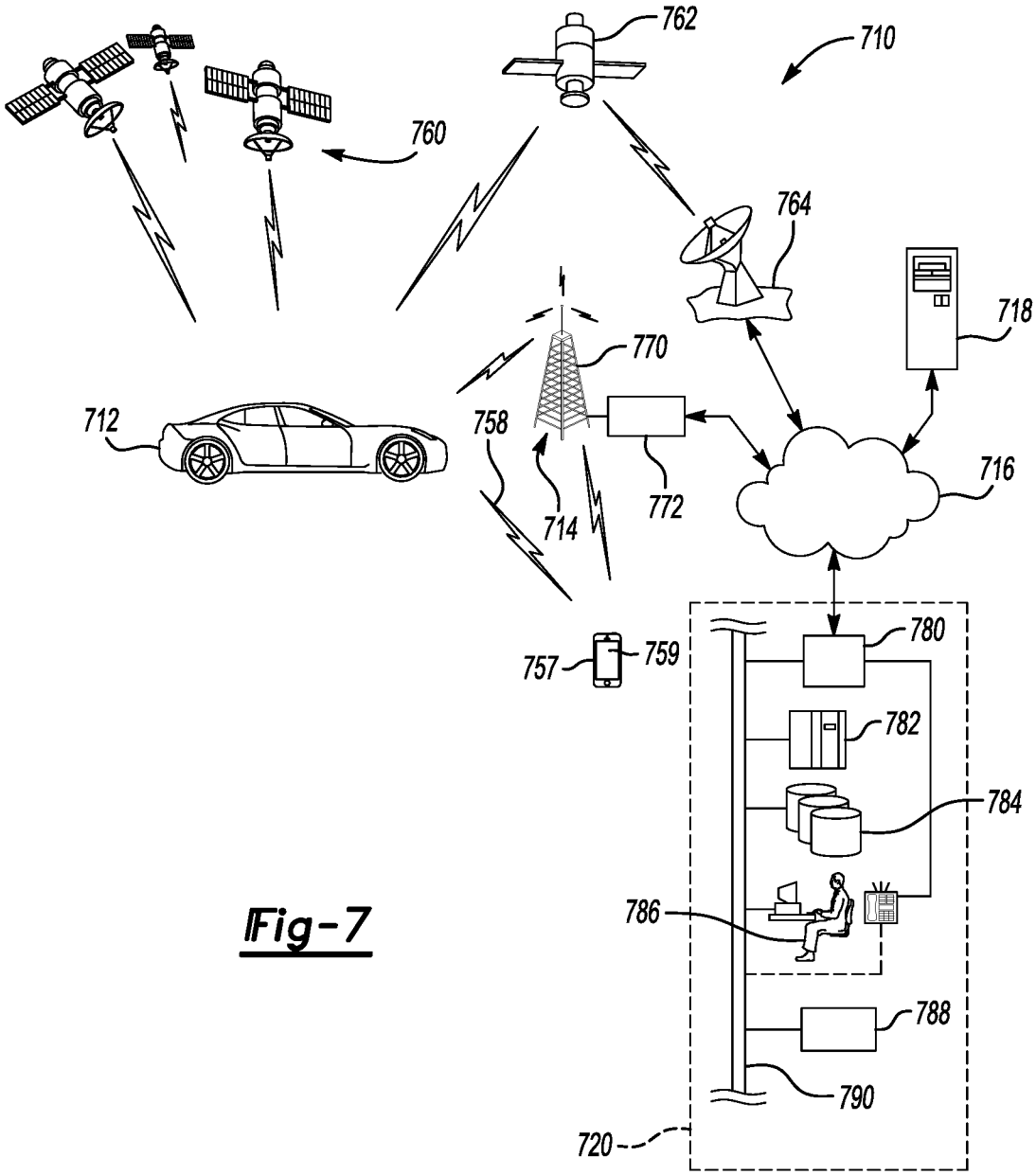
FIG. 7 shows a diagram of a system for reporting a condition of a vehicle component according to an aspect of an exemplary embodiment.

FIG. 7 shows a diagram of a system for reporting a condition of a vehicle component according to an aspect of an exemplary embodiment. In particular, FIG. 7 shows an illustration of an operating environment that comprises a mobile vehicle communications system 710 and that can be used to implement the apparatus and the method that detect a condition of a vehicle component disclosed herein.

Referring to FIG. 7, an operating environment that comprises a mobile vehicle communications system 710 and that can be used to implement apparatus and the method for detecting a condition of a vehicle component is shown. Communications system 710 may include one or more from among a vehicle 712, one or more wireless carrier systems 714, a land communications network 716, a computer 718, and a call center 720. It should be understood that the disclosed apparatus and the method for detect a condition of a vehicle component can be used with any number of different systems and is not specifically limited to the operating environment shown here. The following paragraphs simply provide a brief overview of one such communications system 710; however, other systems not shown here could employ the disclosed apparatus and the method that detect a condition of a vehicle component as well.

Vehicle 712 is depicted in the illustrated embodiment as a passenger car, but it should be appreciated that any other vehicle including motorcycles, trucks, sports utility vehicles (SUVs), recreational vehicles (RVs), marine vessels, aircraft, etc., can also be used. One or more elements of apparatus that detects a condition of a vehicle component shown in FIG. 1 may be incorporated into vehicle 512.

One of the networked devices that can communicate with the communication device 108 is a wireless device, such as a smart phone 757. The smart phone 757 can include computer processing capability, a transceiver capable of communicating using a short-range wireless protocol 758, and a visual smart phone display 759. In some implementations, the smart phone display 759 also includes a touch-screen graphical user interface and/or a GPS module capable of receiving GPS satellite signals and generating GPS coordinates based on those signals.

The GPS module of the communication device 108 may receive radio signals from a constellation 760 of GPS satellites, recognize a location of a vehicle based on the on-board map details or by a point of interest or a landmark. From these signals the communication device 708 can determine vehicle position that is used for providing navigation and other position-related services to the vehicle driver. Navigation information can be presented by the output 104 (or other display within the vehicle) or can be presented verbally such as is done when supplying turn-by-turn navigation. The navigation services can be provided using a dedicated in-vehicle navigation module, or some or all navigation services can be done via the communication device 108. Position information may be sent to a remote location for purposes of providing the vehicle with navigation maps, map annotations (points of interest, restaurants, etc.), route calculations, and the like. The position information can be supplied to call center 720 or other remote computer system, such as computer 718, for other purposes, such as fleet management, maintenance scheduling, and motion determination. Moreover, new or updated map data can be downloaded by the communication device from the call center 720.

The vehicle 712 may include vehicle system modules (VSMs) in the form of electronic hardware components that are located throughout the vehicle and typically receive input from one or more sensors and use the sensed input to perform diagnostic, monitoring, control, reporting and/or other functions. The VSMs may include one or more of the vehicles sensors 107. Each of the VSMs may be connected by a communications bus to the other VSMs, as well as to the controller 101, and can be programmed to run vehicle system and subsystem diagnostic tests. The controller 101 may be configured to send and receive information from the VSMs and to control VSMs to perform vehicle functions. As examples, one VSM can be an electronic controller unit, an engine control module (ECM) that controls various aspects of engine operation such as fuel ignition and ignition timing, another VSM can be an external sensor module configured to receive information from external sensors such as cameras, radars, LIDARs, and lasers, another VSM can be a powertrain control module that regulates operation of one or more components of the vehicle powertrain, another VSM can include one or more of the vehicle sensors 107, and another VSM can be a body control module that governs various electrical components located throughout the vehicle, like the vehicle's power door locks and headlights. According to an exemplary embodiment, the engine control module is equipped with on-board diagnostic (OBD) features that provide myriad real-time data, such as that received from various sensors including vehicle emissions sensors, and provide a standardized series of diagnostic trouble codes (DTCs) that allow a technician to rapidly identify and remedy malfunctions within the vehicle. As is appreciated by those skilled in the art, the above-mentioned VSMs are only examples of some of the modules that may be used in vehicle 712, as numerous others are also available.

Wireless carrier system 714 may be a cellular telephone system that includes a plurality of cell towers 770 (only one shown), one or more mobile switching centers (MSCs) 772, as well as any other networking components required to connect wireless carrier system 714 with land network 716. Each cell tower 770 includes sending and receiving antennas and a base station, with the base stations from different cell towers being connected to the MSC 572 either directly or via intermediary equipment such as a base station controller. Cellular system 714 can implement any suitable communications technology, including for example, analog technologies such as AMPS, or the newer digital technologies such as CDMA (e.g., CDMA2000 or 1×EV-DO) or GSM/GPRS (e.g., 4G LTE). As will be appreciated by those skilled in the art, various cell tower/base station/MSC arrangements are possible and could be used with wireless system 714. For instance, the base station and cell tower could be co-located at the same site or they could be remotely located from one another, each base station could be responsible for a single cell tower or a single base station could service various cell towers, and various base stations could be coupled to a single MSC, to name but a few of the possible arrangements.

Apart from using wireless carrier system 714, a different wireless carrier system in the form of satellite communication can be used to provide uni-directional or bi-directional communication with the vehicle. This can be done using one or more communication satellites 762 and an uplink transmitting station 764. Uni-directional communication can be, for example, satellite radio services, wherein programming content (news, music, etc.) is received by transmitting station 764, packaged for upload, and then sent to the satellite 762, which broadcasts the programming to subscribers. Bi-directional communication can be, for example, satellite telephony services using satellite 762 to relay telephone communications between the vehicle 712 and station 764. If used, this satellite telephony can be utilized either in addition to or in lieu of wireless carrier system 714.

Land network 716 may be a land-based telecommunications network that is connected to one or more landline telephones and connects wireless carrier system 714 to call center 720. For example, land network 716 may include a public switched telephone network (PSTN) such as that used to provide hardwired telephony, packet-switched data communications, and the Internet infrastructure. One or more segments of land network 716 could be implemented using a standard wired network, a fiber or other optical network, a cable network, power lines, other wireless networks such as wireless local area networks (WLANs), or networks providing broadband wireless access (BWA), or any combination thereof. Furthermore, call center 720 need not be connected via land network 716, but could include wireless telephony equipment so that it can communicate directly with a wireless network, such as wireless carrier system 714.

Computer 718 can be one of many computers accessible via a private or public network such as the Internet. Each such computer 718 can be used for one or more purposes, such as a web server accessible by the vehicle via the communication device 708 and wireless carrier 714. Other such accessible computers 718 can be, for example: a service center computer where diagnostic information, vehicle parameters and other vehicle data can be uploaded from the vehicle via the communication device 108; a client computer used by the vehicle owner or other subscriber for such purposes as accessing or receiving vehicle data or to setting up or configuring subscriber preferences or controlling vehicle functions; or a third party repository to or from which vehicle data or other information is provided, whether by communicating with the vehicle 712 or call center 720, or both. A computer 718 can also be used for providing Internet connectivity such as DNS services or as a network address server that uses DHCP or other suitable protocol to assign an IP address to the vehicle 712.

Call center 720 is designed to provide the vehicle electronics with many different system back-end functions and, according to the exemplary embodiment shown here, generally includes one or more switches 780, servers 782, databases 784, live advisors 786, as well as an automated voice response system (VRS) 788. These various call center components may be coupled to one another via a wired or wireless local area network 790. Switch 780, which can be a private branch exchange (PBX) switch, routes incoming signals so that voice transmissions are usually sent to either the live adviser 786 by regular phone or to the automated voice response system 788 using VoIP. The live advisor phone can also use VoIP as indicated by the broken line in FIG. 7. VoIP and other data communication through the switch 780 is implemented via a modem (not shown)

connected between the switch 780 and network 790. Data transmissions are passed via the modem to server 782 and/or database 784. Database 784 can store account information such as subscriber authentication information, profile records, behavioral patterns, and other pertinent subscriber information, and one or more from among vehicle performance, vehicle energy usage, and vehicle vibration and acoustics, vehicle health, a condition of a vehicle component, information on fault tables and associated patterns. The server 782 may be configured to perform on or more operations of the controller 101. Data transmissions may also be conducted by wireless systems, such as 802.11x, GPRS, and the like. Although the illustrated embodiment has been described as it would be used in conjunction with a manned call center 720 using live advisor 786, it will be appreciated that the call center can instead utilize VRS 887 to provide information on vehicle health or a condition of a vehicle component.

The processes, methods, or algorithms disclosed herein can be deliverable to/implemented by a processing device, controller, or computer, which can include any existing programmable electronic control device or dedicated electronic control device. Similarly, the processes, methods, or algorithms can be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms can also be implemented in a software executable object. Alternatively, the processes, methods, or algorithms can be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components.

One or more exemplary embodiments have been described above with reference to the drawings. The exemplary embodiments described above should be considered in a descriptive sense only and not for purposes of limitation. Moreover, the exemplary embodiments may be modified without departing from the spirit and scope of the inventive concept, which is defined by the following claims.

What is claimed is:

1. A method of detecting a condition of a vehicle component, the method comprising:

diagnosing vehicle health of a vehicle by analyzing one or more from among vehicle performance, vehicle energy usage, and vehicle vibration and acoustics;

performing fault isolation on the vehicle to detect a health condition of a vehicle component and determining an isolated fault corresponding to the health condition of the vehicle component if the vehicle health is below a predetermined threshold;

monitoring the vehicle component corresponding to the isolated fault and estimating a remaining useful life of the vehicle component corresponding to the isolated fault; and performing one or more from among continuously monitoring, scheduling maintenance, providing a warning, and performing fault mitigation based on the estimated remaining useful life of the vehicle component corresponding to the isolated fault, wherein the performing fault isolation comprises detecting patterns in values associated with the one or more from among the vehicle performance, the vehicle energy usage, and the vehicle vibration and acoustics, comparing the detected pattern to a table including component faults and a corresponding pattern of values associated with the vehicle performance, the vehicle energy usage, or the vehicle vibration and acoustics, and determining the isolated fault and corresponding component based on the comparing.

2. The method of claim 1, wherein the diagnosing vehicle health of the vehicle by analyzing performance comprises estimating a steering wheel angle based on motor position angle, determining a difference between the estimated steering wheel angle and an actual steering wheel angle, and adjusting the vehicle health if the difference between the estimated steering wheel angle and the actual steering wheel angle is greater than a first predetermined threshold.

3. The method of claim 1, wherein the diagnosing vehicle health of a vehicle by analyzing performance comprises determining whether to perform vehicle motion estimation based on one or more preset conditions corresponding to measured values of steering angle, yaw rate, lateral acceleration, or vehicle longitudinal speed; estimating motion values of the vehicle by estimating lateral acceleration, yaw rate, and roll rate if preset condition is enabled; measuring an actual motion of the vehicle using one or more vehicle motion sensors; determining a difference between the estimated motion of the vehicle and the actual motion of the vehicle; and adjusting the vehicle health if the determined difference between estimated motion of the vehicle and actual motion of the vehicle is greater than a second predetermined threshold.

4. The method of claim 1, wherein the diagnosing vehicle health of a vehicle by analyzing vehicle vibration and acoustics comprises determining whether vehicle vibration acoustics measurements are enabled based on a preset condition, recording one or more from among vibration information from an accelerometer and noise information from a microphone if the preset condition is enabled, determining a difference between acoustic values of the recorded and measured vibration information and noise infuse information at one or more frequency bands with calibrated acoustic values of vehicles at the one or more frequency bands, and adjusting the vehicle health if the determined difference is greater than a third predetermined threshold.

5. The method of claim 1, wherein the diagnosing vehicle health of a vehicle by analyzing vehicle energy usage further comprises determining whether vehicle motion estimation is enabled, calculating expected output average power and output total energy based on input power and energy to the vehicle and normal energy efficiency during vehicle different operation modes of vehicle including braking, acceleration, steering and cruising, estimating average power and total energy output of the vehicle based on the estimated vehicle motion, determining difference between the calculated expected output average power and output total energy and the estimated average power and total energy, and adjusting the vehicle health if the determined difference is greater than a fourth predetermined threshold.

6. The method of claim 1, wherein the estimating the remaining useful life of the vehicle component corresponding to the isolated fault comprises monitoring the component corresponding to the isolated fault for degradation, and estimating the remaining useful life of the component corresponding to the isolated fault based on the degradation.

7. The method of claim 6, wherein the performing one or more from among continuously monitoring, scheduling maintenance, providing a warning, and performing fault mitigation is performed based on the estimated remaining useful life.

8. The method of claim 1, wherein the values associated with vehicle performance comprise steering wheel angle, changing rate of steering wheel angle, yaw rate, lateral acceleration vehicle longitudinal speed, and roll rate, the values associated with vehicle energy usage comprise average energy and average power output by a component, and the values associated with vehicle vibration and acoustics comprise vehicle vibration energy and vehicle noise energy.

9. A non-transitory computer readable medium comprising computer instructions executable by a computer to perform the method of claim 1.

10. An apparatus that detects a condition of a vehicle component, the apparatus comprising:

one or more from among a speed sensor configured to provide information on vehicle performance, an energy meter configured to provide information on vehicle energy usage, and a microphone and an accelerometer configured to provide information on vehicle vibration and acoustics;

at least one memory comprising computer executable instructions; and at least one processor configured to read and execute the computer executable instructions, the computer executable instructions causing the at least one processor to:

diagnose vehicle health of a vehicle by analyzing one or more from among the vehicle performance, the vehicle energy usage, and the vehicle vibration and acoustics;

perform fault isolation on the vehicle to detect a health condition of a vehicle component and determine an isolated fault corresponding to the health condition of the vehicle component if the vehicle health is below a predetermined threshold;

monitor the vehicle component corresponding to the isolated fault and estimating a remaining useful life of the vehicle component corresponding to the isolated fault; and perform one or more from among continuously monitoring, scheduling maintenance, providing a warning, and performing fault mitigation based on the estimated remaining useful life of the vehicle component corresponding to the isolated fault.

11. The apparatus of claim 10, wherein the computer executable instructions cause the at least one processor to diagnose vehicle health of the vehicle by analyzing performance by estimating a steering wheel angle based on motor position angle, determining a difference between the estimated steering wheel angle and an actual steering wheel angle, and adjusting the vehicle health if the difference between the estimated steering wheel angle and the actual steering wheel angle is greater than a first predetermined threshold.

12. The apparatus of claim 10, wherein the computer executable instructions cause the at least one processor to diagnose vehicle health of a vehicle by analyzing performance by: determining whether to perform vehicle motion estimation based on one or more preset conditions corresponding to measured values of steering angle, yaw rate, lateral acceleration, or vehicle longitudinal speed; estimating motion values of the vehicle by estimating lateral acceleration, yaw rate, and roll rate if preset condition is enabled; measuring an actual motion of the vehicle using one or more vehicle motion sensors; determining a difference between the estimated motion of the vehicle and the actual motion of the vehicle; and adjusting the vehicle health if the determined difference between estimated motion of the vehicle and actual motion of the vehicle is greater than a second predetermined threshold.

13. The apparatus of claim 10, wherein the computer executable instructions cause the at least one processor to diagnose vehicle health of a vehicle by analyzing vehicle vibration and acoustics by: determining whether vehicle vibration acoustics measurements are enabled based on a preset condition, recording one or more from among vibration information from an accelerometer and noise information from a microphone if the preset condition is enabled, determining a difference between acoustic values of the recorded and measured vibration information and noise infuse information at one or more frequency bands with calibrated acoustic values of vehicles at the one or more frequency bands, and adjusting the vehicle health if the determined difference is greater than a third predetermined threshold.

14. The apparatus of claim 10, wherein the computer executable instructions cause the at least one processor to diagnose vehicle health of a vehicle by analyzing vehicle energy usage by: determining whether vehicle motion estimation is enabled, calculating expected output average power and output total energy based on input power and energy to the vehicle and normal energy efficiency during vehicle different operation modes of vehicle including braking, acceleration, steering and cruising, estimating average power and total energy output of the vehicle based on the estimated vehicle motion, determining difference between the calculated expected output average power and output total energy and the estimated average power and total energy, and adjusting the vehicle health if the determined difference is greater than a fourth predetermined threshold.

15. The apparatus of claim 10, wherein the computer executable instructions cause the at least one processor to diagnose vehicle health of the vehicle by analyzing vehicle performance, vehicle energy usage, and vehicle vibration and acoustics, and wherein the computer executable instructions cause the at least one processor to perform fault isolation by detecting patterns in values associated with vehicle performance, vehicle energy usage, and vehicle vibration and acoustics, comparing the detected pattern to a table including component faults and a corresponding pattern of values associated with vehicle performance, vehicle energy usage, and vehicle vibration and acoustics, and determining the isolated fault and corresponding component based on the comparison of the detected pattern to the table including component faults.

16. The apparatus of claim 15, wherein the computer executable instructions cause the at least one processor to estimate the remaining useful life of the vehicle component corresponding to the isolated fault by monitoring the component corresponding to the isolated fault for degradation, and estimating the remaining useful life of the component corresponding to the isolated fault based on the degradation.

17. The apparatus of claim 16, wherein the computer executable instructions cause the at least one processor to perform one or more from among continuously monitoring, scheduling maintenance, providing a warning, and performing fault mitigation is performed based on the estimated remaining useful life.

18. The apparatus of claim 15, wherein the values associated with vehicle performance comprise steering wheel angle, changing rate of steering wheel angle, yaw rate, lateral acceleration vehicle longitudinal speed, and roll rate, the values associated with vehicle energy usage comprise average energy and average power output by a component, and the values associated with vehicle vibration and acoustics comprise vehicle vibration energy and vehicle noise energy.

* * * * *